US010376131B2

(12) United States Patent
Gerstner et al.

(10) Patent No.: US 10,376,131 B2
(45) Date of Patent: Aug. 13, 2019

(54) DISHWASHER

(71) Applicant: BSH Hausgeräte GmbH, Munich (DE)

(72) Inventors: Norbert Gerstner, Herbrechtingen (DE); Thomas Steck, Dillingen (DE); Ersin Isbilen, Lauingen (DE)

(73) Assignee: BSH Hausgeräte GmbH, Munich (DE)

( * ) Notice: Subject to any disclaimer, the term of this patent is extended or adjusted under 35 U.S.C. 154(b) by 356 days.

(21) Appl. No.: 15/145,854

(22) Filed: May 4, 2016

(65) Prior Publication Data

US 2016/0331205 A1 Nov. 17, 2016

(30) Foreign Application Priority Data

May 11, 2015 (DE) ..... 10 2015 208 661

(51) Int. Cl.
*A47L 15/50* (2006.01)

(52) U.S. Cl.
CPC ..... *A47L 15/506* (2013.01)

(58) Field of Classification Search
CPC ..... A47L 15/506
USPC ..... 134/56 D
See application file for complete search history.

(56) References Cited

U.S. PATENT DOCUMENTS

| | | | | |
|---|---|---|---|---|
| 2,612,767 | A * | 10/1952 | Castner | D06F 17/06 68/131 |
| 3,768,883 | A | 10/1973 | Kauffman | |
| 5,115,822 | A | 5/1992 | Nichols | |
| 5,971,513 | A | 10/1999 | Cassalia | |
| 6,247,771 | B1 | 6/2001 | Miller | |
| 6,755,490 | B2 | 6/2004 | Welch | |
| 7,625,052 | B2 | 12/2009 | Kim | |
| 7,628,461 | B2 | 12/2009 | Carden | |
| 8,162,419 | B2 | 4/2012 | Dellby et al. | |
| 8,303,053 | B2 | 11/2012 | Bond | |
| 8,550,592 | B2 | 10/2013 | Usuda et al. | |
| 9,004,622 | B2 | 4/2015 | Garcia et al. | |
| 2003/0042825 | A1 | 3/2003 | Welch et al. | |
| 2004/0244825 | A1 | 12/2004 | Welch | |
| 2006/0043848 | A1 | 3/2006 | Jeong | |
| 2006/0091697 | A1 * | 5/2006 | Rasmussen | A47C 17/84 296/156 |
| 2009/0009040 | A1 | 1/2009 | Dellby et al. | |

(Continued)

FOREIGN PATENT DOCUMENTS

| | | | |
|---|---|---|---|
| DE | 102011088914 | A1 | 6/2013 |
| EP | 0147815 | A1 | 7/1985 |

(Continued)

OTHER PUBLICATIONS

JP2006141526A with machine translation (Year: 2006).*
Report of Examination DE 10 2015 208 661.5 dated Jan. 18, 2016.
National Search Report EP 16 16 6108 dated Jun. 22, 2016.

*Primary Examiner* — Michael E Barr
*Assistant Examiner* — Tinsae B Ayalew
(74) *Attorney, Agent, or Firm* — Michael E. Tschupp; Andre Pallapies; Brandon G. Braun

(57) ABSTRACT

A dishwasher includes a receptacle for items to be washed and a lifting device which is configured to lift the receptacle for items to be washed from a starting position into an end position or to lower it from the end position into the starting position. The lifting device has an electrical drive device which is arranged on a dishwasher cavity or on a base support of the dishwasher.

9 Claims, 10 Drawing Sheets

(56) References Cited

U.S. PATENT DOCUMENTS

| | | | | |
|---|---|---|---|---|
| 2010/0045152 | A1* | 2/2010 | Bond | A47B 46/005 312/319.1 |
| 2012/0074080 | A1 | 3/2012 | Garcia | |
| 2015/0002005 | A1 | 1/2015 | Park et al. | |
| 2015/0305493 | A1 | 10/2015 | Garcia et al. | |
| 2017/0027413 | A1 | 2/2017 | Gerstner | |

FOREIGN PATENT DOCUMENTS

| | | | | |
|---|---|---|---|---|
| EP | 0147815 | A2 * | 7/1985 | A47L 15/506 |
| EP | 1066789 | A1 | 1/2001 | |
| JP | 2000000201 | A | 1/2000 | |
| JP | 2001224547 | A | 8/2001 | |
| JP | 2006141515 | A | 6/2006 | |
| JP | 2006141516 | A | 6/2006 | |
| JP | 2006141526 | A * | 6/2006 | A47L 15/0084 |
| JP | 2006141526 | A | 6/2006 | |
| WO | 2009110861 | A1 | 9/2009 | |
| WO | 2014102367 | A1 | 7/2014 | |
| WO | 2014102374 | A1 | 7/2014 | |
| WO | 2015091646 | A1 | 6/2015 | |

* cited by examiner

DISHWASHER

CROSS-REFERENCES TO RELATED APPLICATIONS

This application claims the priorities of German Patent Application, Ser. No. 10 2015 208 661.5, filed May 11, 2015, pursuant to 35 U.S.C. 119(a)-(d), the disclosure of which is incorporated herein by reference in its entirety as if fully set forth herein.

BACKGROUND OF THE INVENTION

The present invention relates to a dishwasher.

A dishwasher has a dishwasher cavity and at least one receptacle for items to be washed that can be moved into or out of the dishwasher cavity. In particular, the dishwasher can have a number of receptacles for items to be washed that are arranged one above the other, such as for instance a bottom basket, a top basket or a cutlery basket. Since the bottom basket is arranged close to a base of the dishwasher cavity, in order to load and unload the bottom basket it is necessary for the user to flex his knees or bend towards the bottom basket.

The publication EP 2 818 092 A1 describes a dishwasher with a lifting device for a bottom basket of the dishwasher. With the aid of the lifting device, the bottom basket can be moved from a lower position into an upper position or vice versa. The lifting device comprises a drive device.

Against this background, it is an object of the present invention to provide an improved dishwasher.

SUMMARY OF THE INVENTION

Accordingly, a dishwasher with a receptacle for items to be washed and a lifting device is proposed. The lifting device is designed to lift the receptacle for items to be washed from a starting position into an end position or to lower it from the end position into the starting position, wherein the lifting device has an electrical drive device which is arranged on a dishwasher cavity or on a base support of the dishwasher.

The capability of the electrical drive device to be positioned freely allows the electrical drive device to be placed with no significant impact on the architecture of the dishwasher. This produces great design freedom. Furthermore, the installation space available for the electrical drive device can be used optimally. The drive device is preferably arranged outside of, in particular completely outside of the dishwasher cavity. The drive device is preferably provided on the outside of the dishwasher cavity. The dishwasher is preferably a domestic dishwasher.

According to one embodiment, the electrical drive device can include an active drive element, in particular an electric motor.

The electrical drive device may have a number of drive elements.

According to a further embodiment, the electrical drive device can include a transmission.

The driving force of the drive element can be translated thereby. As a result, the drive element can be dimensioned smaller, as a result of which the dishwasher can be manufactured more cost-effectively and the available installation space can be better utilized.

According to a further embodiment, the transmission can be a worm gear.

The transmission is advantageously a self-locking worm gear. This prevents the receptacle for items to be washed from automatically moving back from the end position into the starting position due to its tare weight.

According to a further embodiment, the transmission can include a worm wheel which is non-rotatably connected to a swivel arm of the lifting device and a worm that engages into the worm wheel.

The lifting device can include two swivel arms, which are pivotably connected both with the dishwasher cavity of the dishwasher and also with a guide device of the receptacle for items to be washed. The worm wheel is advantageously connected with just one of the swivel arms.

According to a further embodiment, the worm wheel can have a circle segment shape.

Installation space can be saved thereby. Furthermore, the weight of the worm wheel and thus of the dishwasher can be reduced thereby.

According to a further embodiment, the worm can be secured to a drive shaft, which is arranged on a front side and vertically on the dishwasher cavity.

The drive shaft advantageously runs on the front side of the dishwasher cavity from the active drive element downwards in the direction of the worm wheel.

According to a further embodiment, the drive shaft can be coupled to an active drive element, in particular an electric motor, of the electrical drive device with the aid of a bevel gear.

The bevel gear allows a rotational movement of the active drive element to be deflected about 90°.

According to a further embodiment, an active drive element, in particular an electric motor, of the electrical drive device can be arranged on a side wall of the dishwasher cavity, a ceiling of the dishwasher cavity or a transition area between the side wall and the ceiling.

In particular, the active drive element can be positioned entirely freely. Any design of the dishwasher is possible in this way.

According to a further embodiment, provision may be made for an active drive element, in particular an electric motor, of the electrical drive device instead of a counterweight which can be arranged in the base support.

The drive element can replace the counterweight entirely or partially. In this way it is possible to completely dispense with the counterweight or for it at least to be dimensioned smaller. This allows the dishwasher to be manufactured more cost-effectively.

According to a further embodiment, the dishwasher can include two electrical drive devices.

An electrical drive device is preferably provided on each of two opposing side walls of the dishwasher cavity.

Further possible implementations of the dishwasher also comprise combinations—not explicitly cited—of features or embodiments described above or below in respect of the exemplary embodiments. Here the person skilled in the art will also add individual aspects as improvements or amendments to the respective basic form of the dishwasher.

BRIEF DESCRIPTION OF THE DRAWING

Further advantageous embodiments and aspects of the dishwasher form the subject matter of the subclaims and the exemplary embodiments of the dishwasher described below. The dishwasher is also described in greater detail on the basis of preferred embodiments with reference to the attached figures, in which:

DETAILED DESCRIPTION OF PREFERRED EMBODIMENTS

Figure 1:
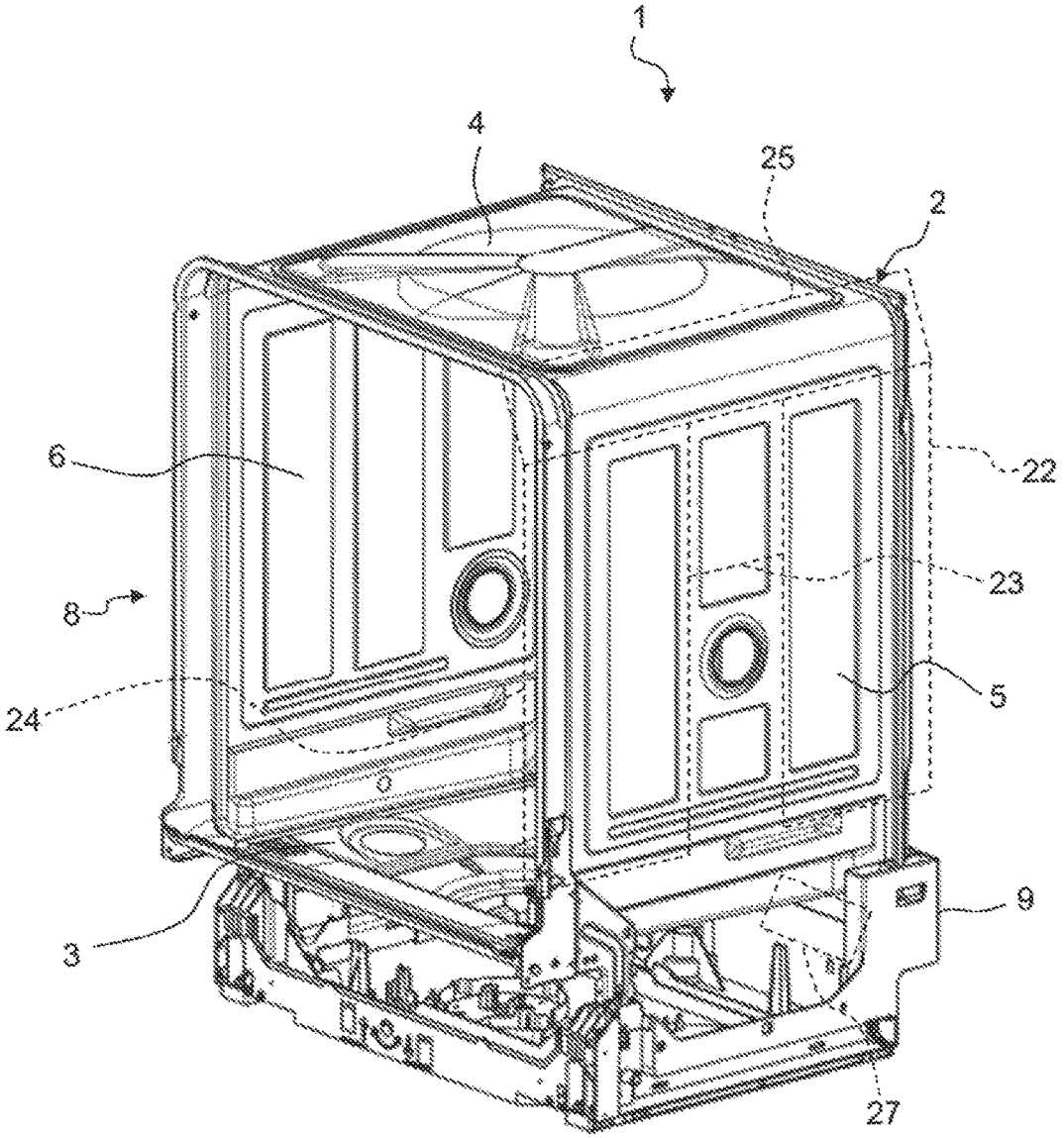
FIG. 1 shows a schematic perspective view of an embodiment of a dishwasher.

Elements which are the same or function the same have been provided with the same reference characters in the figures, unless specified otherwise.

Figure 2:
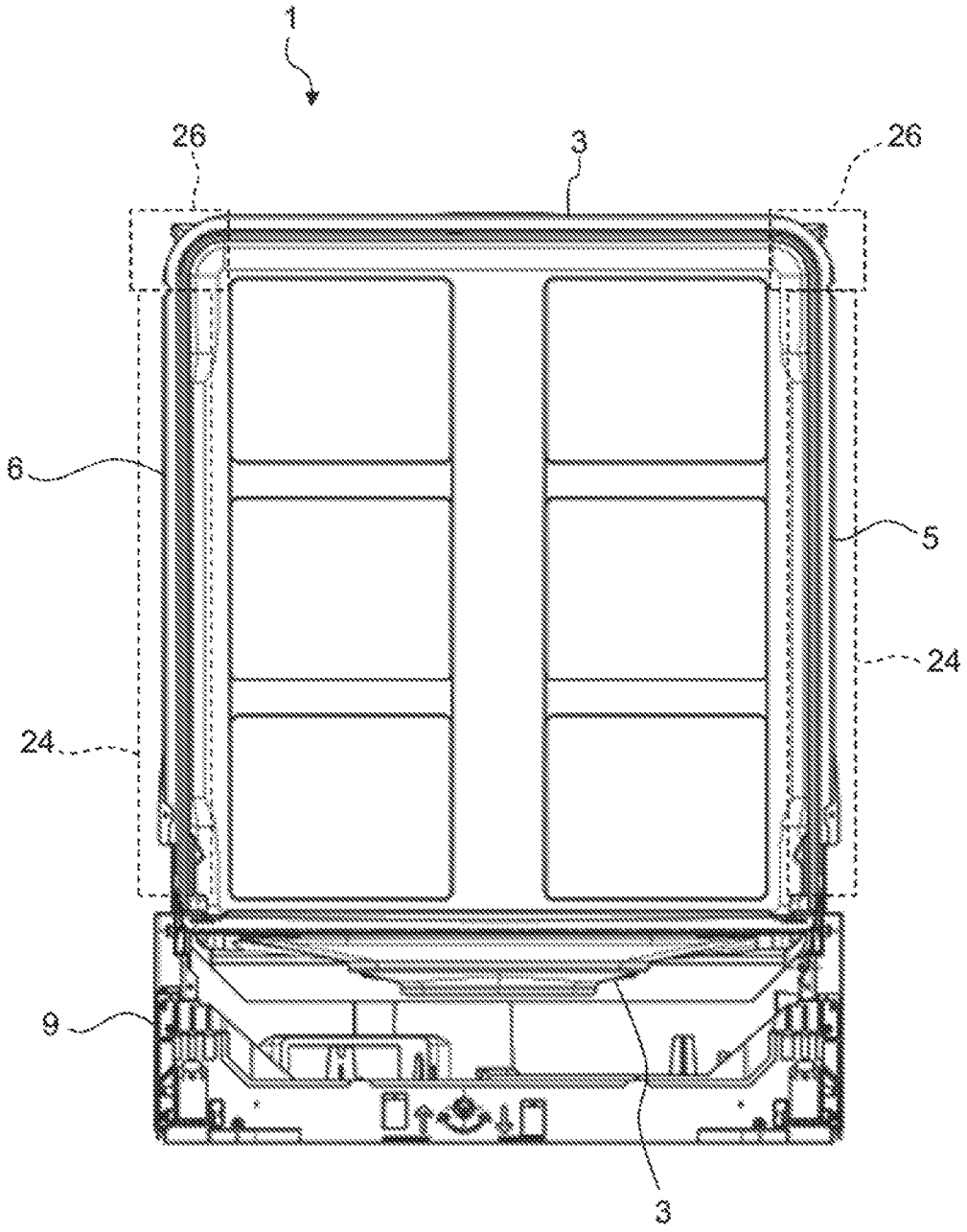
FIG. 2 shows a schematic front view of the dishwasher according to FIG. 1.
Figure 3:
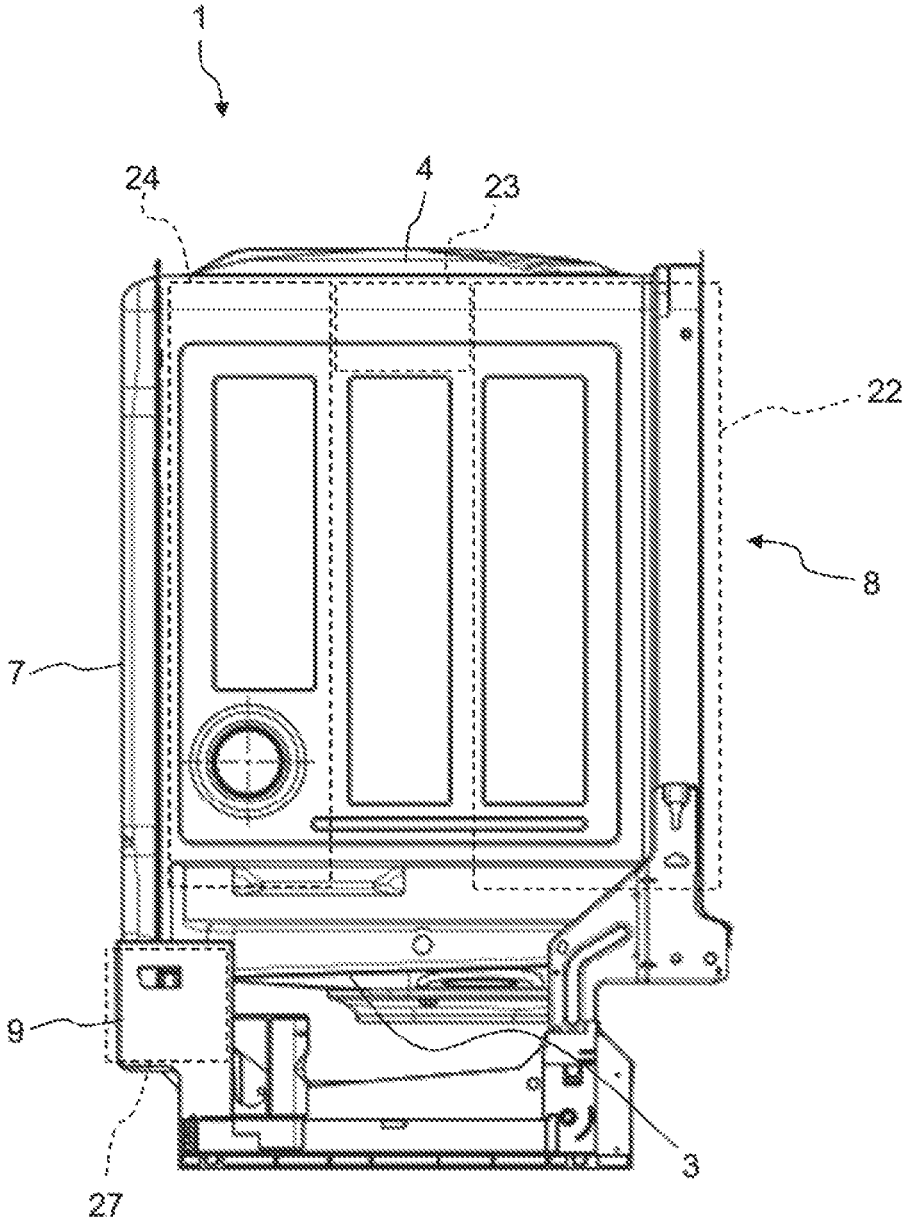
FIG. 3 shows a schematic side view of the dishwasher according to FIG. 1.

FIG. 1 shows a schematic perspective view of a dishwasher 1. The dishwasher 1 is preferably a domestic dishwasher. FIG. 2 shows the dishwasher 1 in a schematic front view, FIG. 3 shows the dishwasher 1 in a schematic side view. Reference is made below simultaneously to FIGS. 1 to 3.

The dishwasher 1 has a dishwasher cavity 2. The dishwasher cavity 2 is in particular cuboid-shaped. The dishwasher cavity 2 is preferably manufactured from steel sheet. Alternatively, the dishwasher cavity 2 can be manufactured at least partially from a plastic material. The dishwasher cavity 2 comprises a base 3, a ceiling 4 arranged opposite to the base 3, two oppositely arranged side walls 5, 6, a rear wall 7 and a loading opening 8 arranged opposite to the rear wall 7. The loading opening 8 can be sealed in a watertight manner with a door (not shown in FIGS. 1 to 3). Force distributors can be provided at the corners of the dishwasher cavity 2. The dishwasher cavity 2 is arranged on a base support 9 of the dishwasher 1. The base support 9 is preferably a plastic injection molded component. The base support 9 is in particular block-shaped.

The dishwasher 1 may further comprise a number of receptacles for items to be washed that can be accommodated in the dishwasher cavity 2. The receptacles for items to be washed can be moved into and out of the dishwasher cavity 2 with the aid of guide devices. Furthermore, the dishwasher 1 has a lifting device 10 (FIG. 4, FIG. 5), which is designed to move a lower receptacle for items to be washed or a bottom basket from a starting position, in which it is pulled out from the dishwasher cavity 2, into an end position, in which the lower receptacle for items to be washed is arranged approximately at the height of an upper receptacle for items to be washed.

Figure 4:
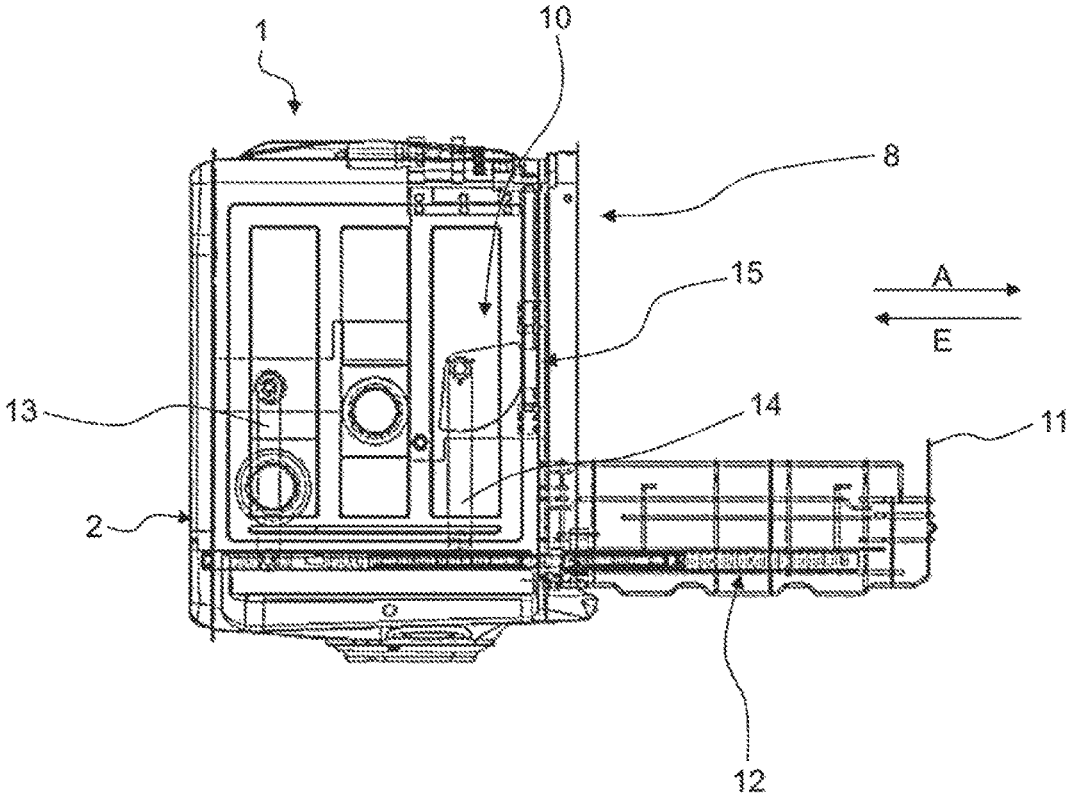
FIG. 4 shows a further schematic side view of the dishwasher according to FIG. 1.
Figure 5:
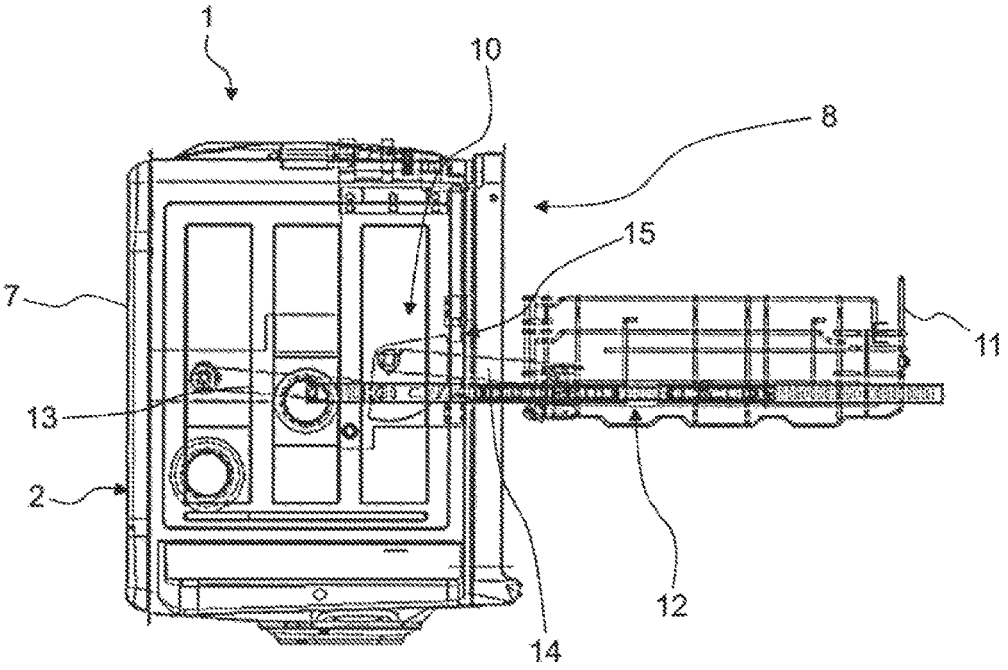
FIG. 5 shows a further schematic side view of the dishwasher according to FIG. 1.

FIGS. 4 and 5 show the dishwasher 1 in a schematic side view in each case. The dishwasher 1 has a bottom basket or a lower receptacle for items to be washed 11. FIG. 4 shows the lower receptacle for items to be washed 11 in the starting position. FIG. 5 shows the receptacle for items to be washed 11 that is lifted into the end position with the aid of the lifting device 10. The receptacle for items to be washed 11 is guided into the dishwasher cavity 2 with the aid of a guide device 12. The guide device 12 may be what is known as a telescopic rail. The lifting device 10 comprises a first swivel arm 13 and a second swivel arm 14, which are pivotably mounted on one of the side walls 5, 6. Furthermore, the swivel arms 13, 14 are pivotably mounted on the guide device 12. The lifting device 10 further comprises an electrical drive device 15, which is arranged on the dishwasher cavity 2 or on the base support 9 of the dishwasher 1.

Figure 6:
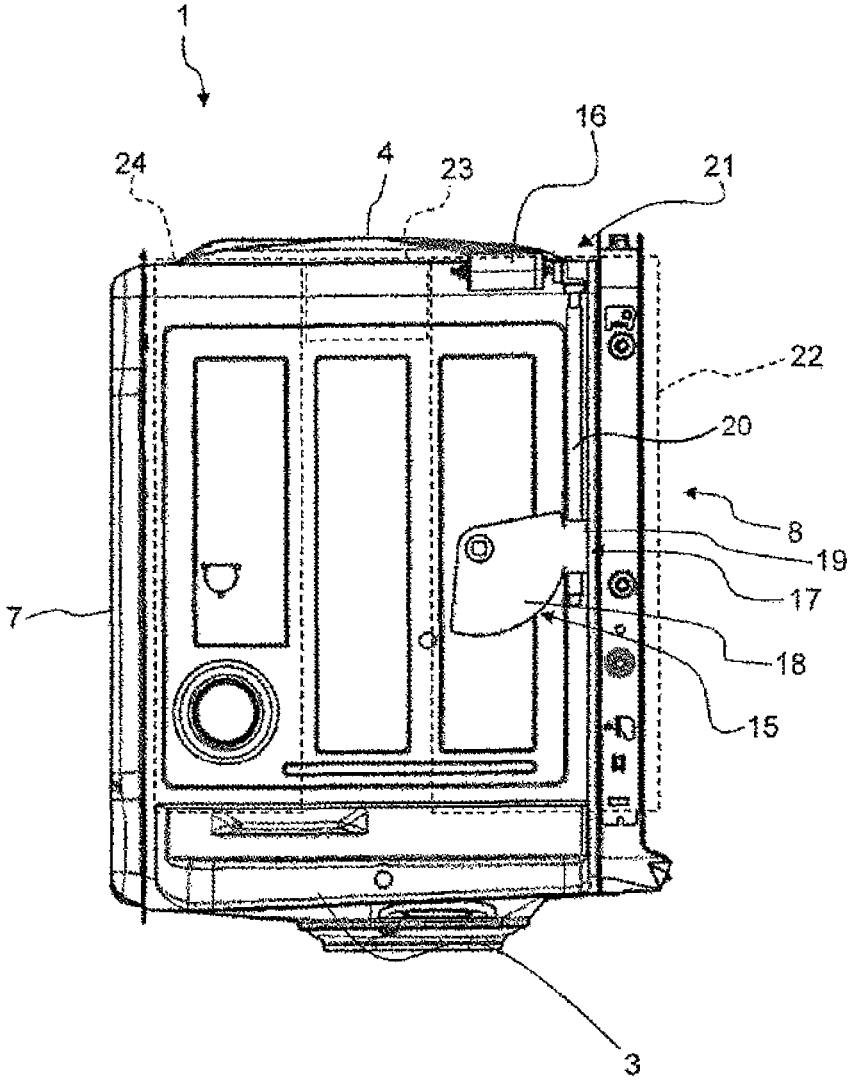
FIG. 6 shows a further schematic side view of the dishwasher according to FIG. 1.
Figure 7:
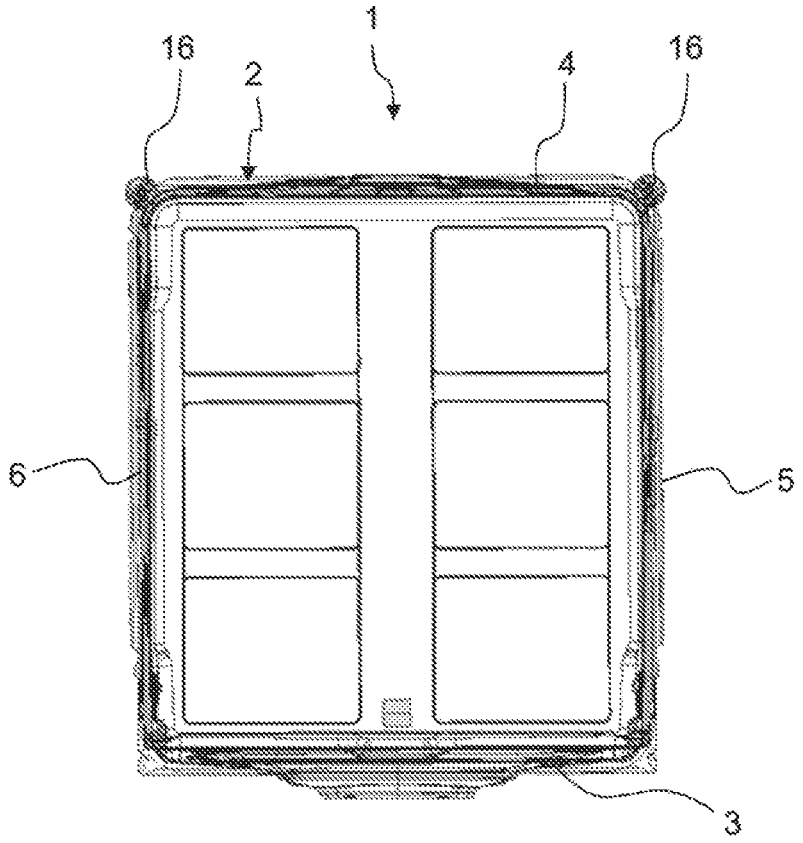
FIG. 7 shows a further schematic front view of the dishwasher according to FIG. 1.
Figure 8:
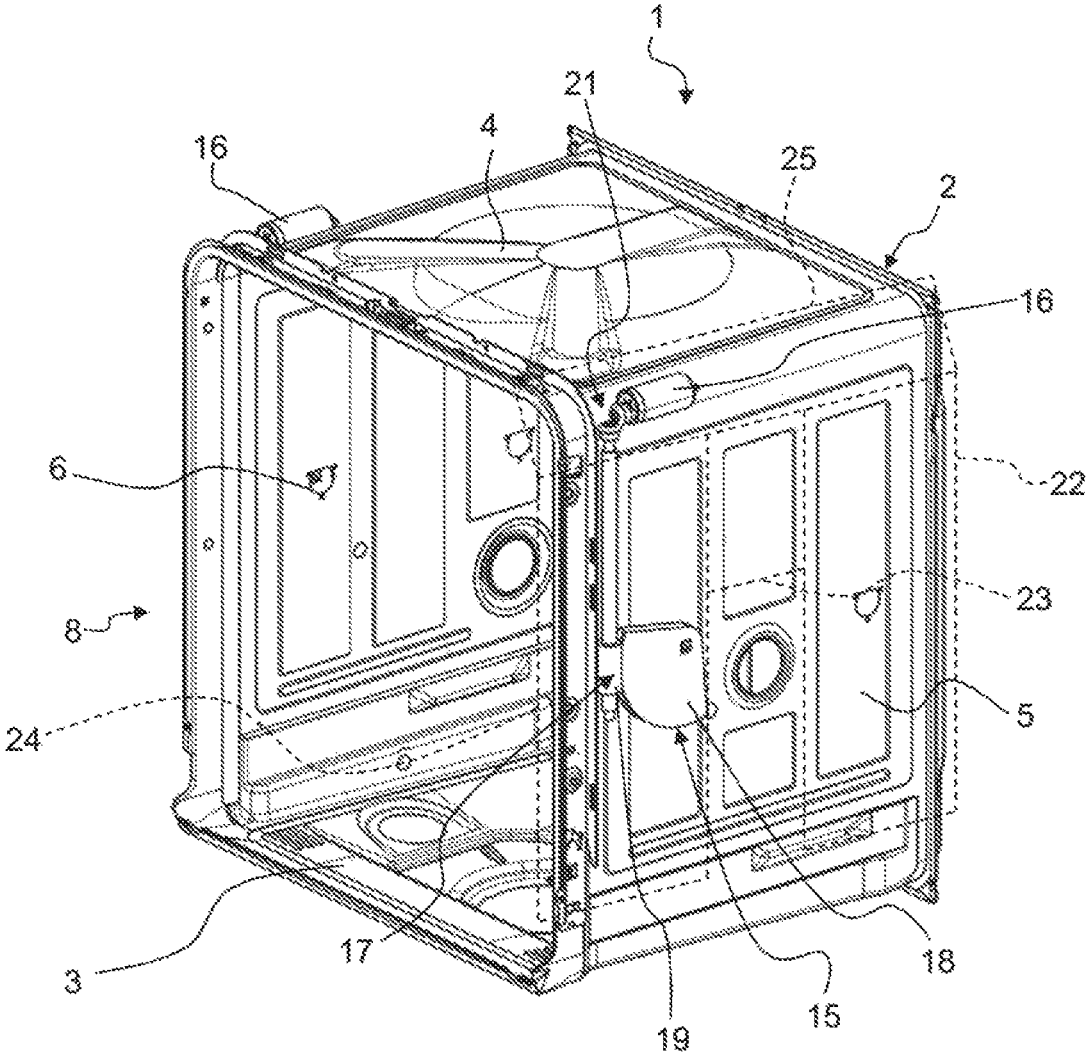
FIG. 8 shows a further schematic perspective view of the dishwasher according to FIG. 1.

FIGS. 6, 7 and 8 show the dishwasher 1 in a schematic side view, in a schematic front view and in a schematic perspective view, without the lifting device 10 in each case. The electrical drive device 15 may comprise an active drive element 16. The drive element 16 may be an electric motor, as shown in FIGS. 6, 7 and 8. As FIGS. 7 and 8 also show, an electrical drive device 15 of this type with a drive element 16 can be provided on both side walls 5, 6.

The electrical drive device 15 further comprises a transmission 17. The transmission 17 is preferably a worm gear with a worm wheel 18 non-rotatably connected to the swivel arm 14 of the lifting device 10 and a worm 19 that engages into the worm wheel 18. As FIG. 6 shows, the worm wheel 18 has in particular a circle segment shape. Alternatively, the worm wheel 18 may be circular. The worm 19 is non-rotatably secured on a drive shaft 20, which is arranged on the front side and vertically on the dishwasher cavity 2. In particular, the drive shaft 20 is coupled to the drive element 16 of the electrical drive device 15 with the aid of a bevel gear 21. The bevel gear 21 may have two taper gears, of which one is secured to the drive shaft 20 and the other to a drive shaft of the drive element 16.

Figure 9:
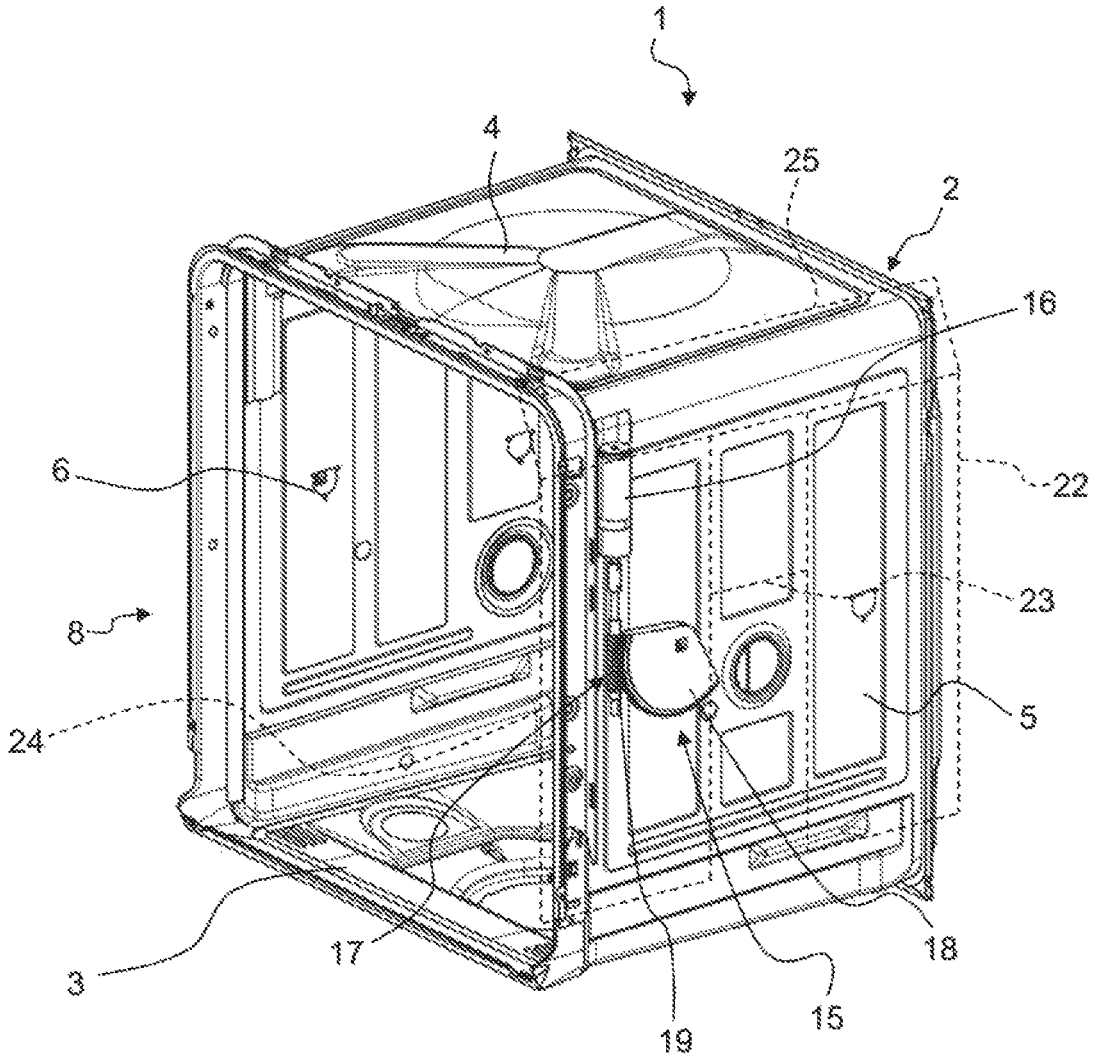
FIG. 9 shows a schematic perspective view of a further embodiment of a dishwasher.
Figure 10:
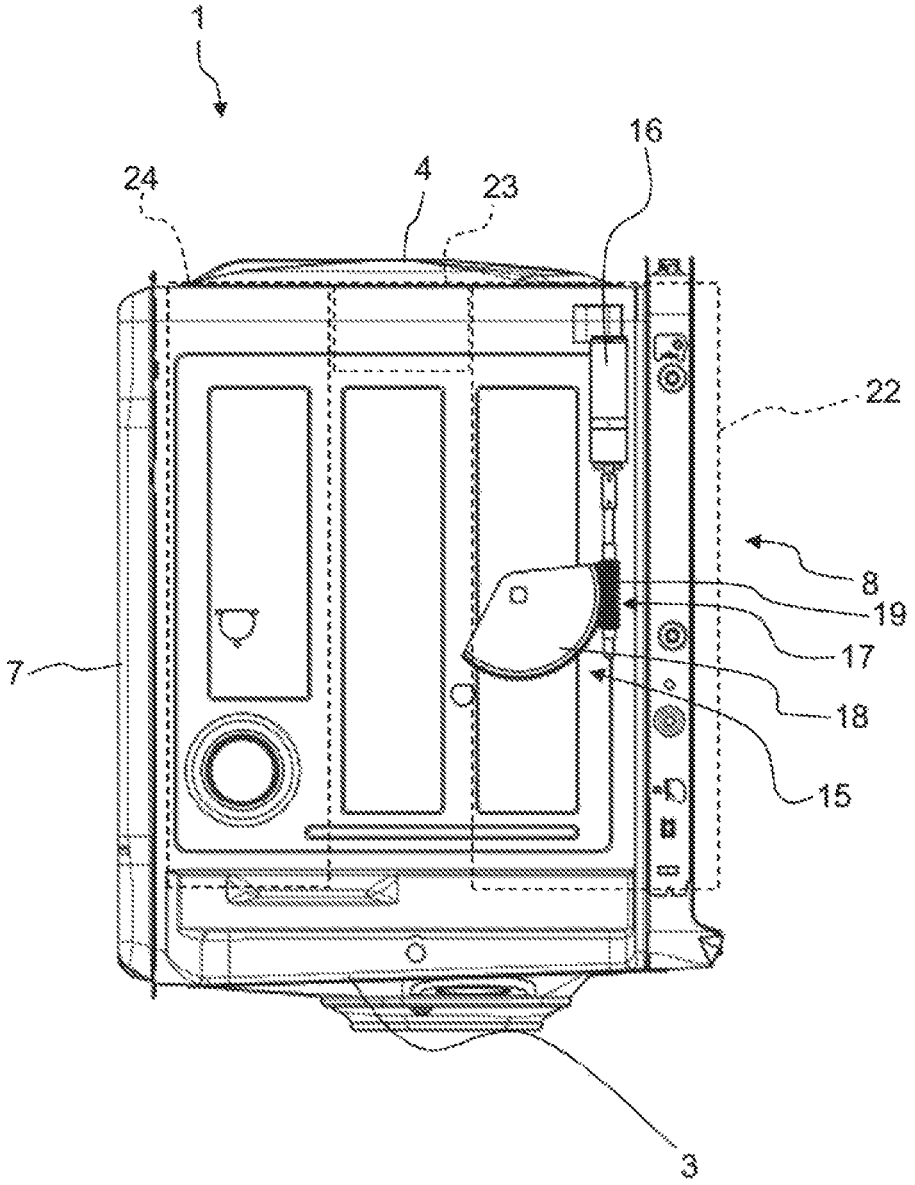
FIG. 10 shows a schematic side view of the dishwasher according to FIG. 9.

FIGS. 9 and 10 show a further embodiment of a dishwasher 1 in a schematic perspective view and in a schematic side view in each case. The dishwasher 1 according to FIGS. 9 and 10 differs from the dishwasher 1 according to FIGS. 4 to 8 in that the drive device 15 is embodied as a direct drive. In other words, the bevel gear 21 can be dispensed with and the drive element 16 can be assembled directly on the side walls 5, 6 for instance.

Now returning to FIGS. 1 to 3, the electrical drive device 15 and in particular the drive element 16 can be provided on or in areas 22 to 26 bordered with the aid of dashed lines. In particular, the drive element 16 of the electrical drive device 15 can be arranged to the left or right on one of the side walls 5, 6 or on both side walls 5, 6 of the dishwasher cavity 2, on the ceiling 4 or on a transition area 25 between the side wall 5, 6 and the ceiling 4. Furthermore, the electrical drive device 15, as shown in FIG. 2, can be provided in the area 26 of a force distributor provided on the dishwasher cavity 2. In particular, the electrical drive device 15 and in particular the drive element 16 can also be provided on or in the base support 9. It is preferably possible here to dispense with a counterweight provided in the base support 9. For instance, the drive device 15 can be arranged on an area 27 of the base support 9. The capability of the drive element 16 to be positioned freely allows the electrical drive device 15 to be integrated into the dishwasher 1 without a significant impact on the device architecture.

Although the present invention was described on the basis of exemplary embodiments, it can be modified in a variety of ways.

What is claimed is:

1. A dishwasher, comprising:

a dishwasher cavity, the dishwasher cavity comprising a base, a ceiling arranged opposite to the base, two oppositely arranged side walls, a rear wall, and a loading opening arranged opposite to the rear wall, the loading opening being closable with a door, an upper rounded corner transition area being defined between at least one of the side walls and the ceiling, the upper rounded corner transition area forming an exterior space;

a receptacle for items to be washed, the receptacle being configured for movement into and out of the dishwasher cavity; and a lifting device configured to lift the receptacle from a starting position into an end position or to lower the receptacle from the end position into the starting position, said lifting device including an electrical drive device comprising an electric motor which is arranged on an exterior of the upper rounded corner transition area within the exterior space so that the electric motor does not project beyond an exterior of the at least one of the side walls and an exterior of the ceiling.

2. The dishwasher of claim 1, wherein the electrical drive device comprises a transmission.

3. The dishwasher of claim 2, wherein the transmission is a worm gear.

4. The dishwasher of claim 2, wherein the transmission comprises a worm wheel that is non-rotatably connected to a swivel arm of the lifting device and comprises a worm that engages into the worm wheel.

5. The dishwasher of claim 4, wherein the worm wheel has a circle segment shape.

6. The dishwasher of claim 4, wherein the worm is secured to a drive shaft, which is arranged on a front side and vertically on the dishwasher cavity and at a position located below the electric motor.

7. The dishwasher of claim 6, further comprising a bevel gear, said electric motor being coupled to the drive shaft via the bevel gear.

8. The dishwasher of claim 1, wherein the lifting device includes two of said electrical drive device, such that one electric motor is arranged on the exterior of the upper rounded corner transition area between the one of the two side walls and the ceiling and another electric motor is arranged on an exterior of an upper rounded corner transition area between the other of the two side walls and the ceiling.

9. A dishwasher, comprising:

a dishwasher cavity, the dishwasher cavity comprising a base, a ceiling arranged opposite to the base, two oppositely arranged side walls, a rear wall, and a loading opening arranged opposite to the rear wall, the loading opening being closable with a door;

a receptacle for items to be washed, the receptacle being configured for movement into and out of the dishwasher cavity; and a lifting device configured to lift the receptacle from a starting position into an end position or to lower the receptacle from the end position into the starting position, said lifting device including an electrical drive device comprising an electric motor which is arranged on a base support of the dishwasher beneath the base of the dishwasher cavity and in which the electric motor is positioned in an area at a rear of the base support so as to function as a counterweight to a weight of the door and of the receptacle on condition that the door is open and the receptacle is disposed outside of the dishwasher cavity.

* * * * *